United States Patent [19]

Kraus et al.

[11] 4,041,710

[45] Aug. 16, 1977

[54] HYDRAULIC PRIME MOVER DEVICE

[76] Inventors: Robert August Kraus; Edmund Josef Kraus, both of 14160 Redhill No. 39, Tustin, Calif. 92680

[21] Appl. No.: 721,849

[22] Filed: Sept. 9, 1976

[51] Int. Cl.[2] ..... F01K 25/06

[52] U.S. Cl. ..... 60/673; 60/689

[58] Field of Search ..... 60/673, 649, 650, 682, 60/689

[56] References Cited

U.S. PATENT DOCUMENTS 3,358,451 12/1967 Feldman ..... 60/649

FOREIGN PATENT DOCUMENTS 657,020 2/1949 United Kingdom ..... 60/689

*Primary Examiner*—Allen M. Ostrager

[57] ABSTRACT

The invention described herein is a new and novel prime mover device which operates as in integral component of a heat vapor cycle which, in combination, represents a heat engine system consisting of a closed, vertically oriented fluid recirculation system, utilizing a non-compressible fluid as a working medium.

Wherein the device's fluid downward flowing section comprises a fluid penstock and a hydraulic turbine, whose function is the conversion of the downward flowing fluid's potential energy into kinetical energy and then into mechanical energy by driving the turbine which, in turn, drives the electrical generator.

Whereas the device's upward flowing section serves the function of lifting the turbine exhausted fluid back to its initial potential, which is accomplished by the heating of the turbine exhausted fluid and its maintenance at operating temperature, in combination with induction of a cooled, condensed gas into the heated fluid at the device's lowermost effective portion which, by virtue of its heat absorption from the fluid, as well as its evaporation and subsequent expansion therein, displaces an equivalent amount of fluid within the device's vertical riser, thus giving rise to the lowering of the fluid's specific gravity within the device's upward flowing section, in contrast to the fluid's specific gravity within its downward flowing section. This causes the fluid to circulate as long as a steady supply of thermal energy, as well as a steady flow of cooled gas, is available. The gas, upon heating and expansion, is separated from the fluid, then cooled and condensed to initial state.

2 Claims, 2 Drawing Figures

HYDRAULIC PRIME MOVER DEVICE

FIELD OF THE INVENTION

The device described herein may be employed wherever abundant low-temperature thermal energy sources are available which otherwise are considered economically not convertible into power and are, therefore, doomed to waste, such as solar, geothermal and atmospheric heat, as well as waste heat from existing steam power plants (conventional or nuclear).

PRIOR ART

To the best of the inventor's knowledge, there is no comparable existing scheme which utilizes a recirculating hydro-electric prime mover in combination with a composite heat vapor cycle, nor do the inventors have prior knowledge of a publication about such devices which may be compared with the state of art herein, except for the specification and patent claims set forth in the inventors' earlier patent application covering a similar system with the title "Waste Heat Regenerating System" filed at the United States Patent Office on Oct. 10, 1975, with the Ser. No. 622,266; Gr. ART UNIT 314, whereby the device described herein, in contrast to the system in the earlier patent application, comprises a primary heating means for the heating of the circulating fluid immediately after leaving the device's hydraulic-turbine, as well as comprising the induction of a cooled gas at liquid state to the heated fluid, which is not included in the patent application Ser. No. 622,266.

SUMMARY

One of the most pressing auxiliary problems concerning us today is the ever-increasing demand for the production of electrical power, which is nearly always and everywhere greater than its supply.

Conventional fossil fuels may slowly be depleting, which demands the immediate development of alternate energy sources. Fortunately, there is an abundance of low-tempeature energy sources in the range of between 50° F to 250° F waiting to be tapped and converted into electrical power.

Such energy sources, because of their low temperature, and because of the then still plentiful fossil fuels, have been thought of as being uneconomical to convert. The present notable shortages of conventional fuels and their ever-increasing cost, makes it necessary and possible to tap these available low-temperature energy sources now.

Conventional prime movers currently employed by the power-generating industry, such as the turbine types, are very inefficient at operating pressures which may be expected through the use of such relatively low-temperature energy sources, since their efficiency sharply increases with the increase of their operating temperature and vice versa, as their operating temperature drops.

In order to produce power from energy sources so low in temperature as to be ignored until now, it is necessary to resort to extraordinary conceptional schemes for the implementation of devices to do so.

OBJECTS OF THE INVENTION

It is, therefore, an object of our invention to provide an economically feasible scheme for the production of electrical power through the conversion of abundantly available low-temperature heat sources which are otherwise doomed to waste, such as from solar, geothermal and atmospheric heat, as well as from waste heat from existing steam power plants (conventional or nuclear).

Another object of the invention is the lowering of the initial construction and maintenance cost for such systems.

Still another object is to implement a non-environment polluting scheme for the production of power.

Those and other objects will become apparent through the study of the specification and appended claims herein.

BRIEF DESCRIPTION OF THE DRAWINGS

Drawing 1.

Drawing 2.

Figure 1:
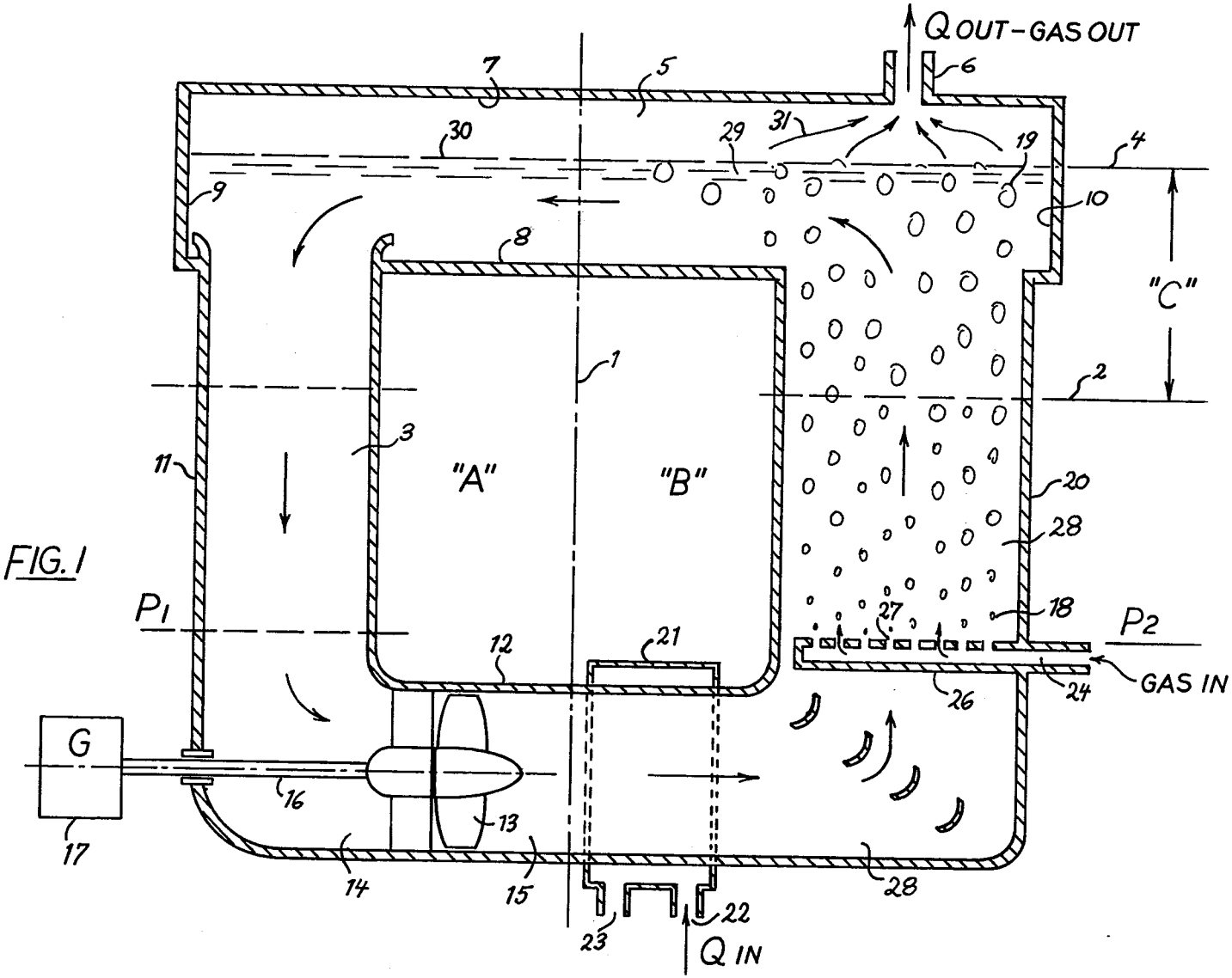
FIG. 1 is a schematic sectional side view of the herein described prime mover device showing it separately without its connected heat vapor cycle.

In accordance with the foregoing, the device illustrated in Drawing 1 is a closed, vertically oriented fluid recirculation system which, for purpose of explanatory simplification only, is herein hypothetically divided by the vertical dotted line 1, into Section A, which is fluid downward flow oriented and into Section B, which is fluid upward flow oriented. It represents the prime mover component of a composite heat engine system being filled to a predetermined initial fluid level 2 with a non-compressible fluid 3 (which may be ordinary water).

The initial fluid level 2 is located substantially below the level 4 which is assumed when the device is in operation.

Section A comprises one half of the device's gas separator 5 having the gas outlet port 6, but otherwise being hermetically sealed by its containment top 7, the fluid crossover 8 and its side walls 9 and 10, as well as comprising the vertical turbine penstock 11, incorporating the lower fluid crossover 12 at the device's lowermost portion and a low-pressure hydraulic turbine 13 having the turbine inlet 14 and the turbine outlet 15, which turbine is rotatably connected via shaft 16 to the electrical generator 17, wherein the arrangement of the device's Section A serves the function of generating electrical power through the conversion of the downward flowing fluid's kinetical energy within the device's turbine 13.

The power which turbine 13 may develop is the function of the hydro-dynamic, pressure-differential's magnitude between points $P_1$ and $P_2$ at the device's lowermost effective portion $P_1$ and $P_2$ respectively, and the quantitative magnitude of the available fluid flowing through said turbine per unit time, which quantitative magnitude of available flowing fluid is in direct proportion to the valumetric fluid displacement of the therein upward expanding gas 18–19, within the device's vertical riser 20 at an equal unit of time.

In contrast to the function of the device's Section A, its Section B serves the function of lifting the turbine exhausted fluid back up to its initial potential 4 for the start of a new cycle on its way downward in a manner described as follows:

After the device's proper filling, the fluid 3 is heated to and is being maintained at its operational temperature by the fluid's primary heating means 21 having a heating fluid inlet 22 and its outlet 23. Thus, upon attainment of the fluid's operational temperature, a cooled gas 24 having a boiling point substantially lower than that of water is forced by pump 25, Drawing 2, FIG. 2, at liquid state and under pressure through the gas inducer 26 and the openings of its gas dispersion nozzles 27 into the heated fluid 28 where immediately upon contact with the heated fluid 28, the cooled gas's heat absorption from said heated fluid gives rise to the gas's evaporating and subsequent expansion with the formation of great quantities of tiny bubbles 18. These bubbles, by virtue of their buoyancy, are rising upward to full expansion 19 and then separate from the fluid 29 by breaking through its surface 30. The separated, fully expanded gas 31 collected between the fluid's surface 30 and the gas separator's top 7, then leaves through the gas separator's gas outlet 6 and is piped to the heat engine system's condenser-coder 32, Drawing 2, FIG. 2.

Upon the induction of the cooled gas 24 to the heated fluid 28, due to the gas's evaporation and subsequent expansion within the heated fluid 28 and the device's vertical riser 20, the expanding gas's fluid displacing action rises the fluid's initial level 2 to the assumed level 4 (C), giving rise to the lowering of the combined fluid-gas content's specific gravity at Section B as in contrast to the fluid's specific gravity at Section A, thereby establishing a difference in the fluid's gravitational potential between Section A and Section B and causing a corresponding difference in the fluid's head pressures at $P_1$ and $P_2$ respectively.

Thus, by virtue of the fluid's higher gravitational potential at Section A over that at Section B, the device's contained fluid is circulated in the direction of the arrow flowing from the gas separator 5 through the penstock 11 downward, crossing over through the device's turbine 13 and the fluid's primary heating means 21 and then upward through the vertical riser 20 and back to the gas separator 5. This circulation may be maintained as long as a sufficient amount of thermal energy is supplied to the device's primary heating means 21 through its inlet port 22 and as long as a steady flow of cooled gas 24 is supplied to the heated fluid 28 through the gas inducer 26.

The circulating fluid's higher potential energy at Section A is first converted into kinetical energy when set into downward motion within the device's penstock 11 and this again is converted into mechanical energy by driving the turbine-wheel 13 which, in turn, drives the rotor of the dynamo, thus generating electrical power.

Figure 2:
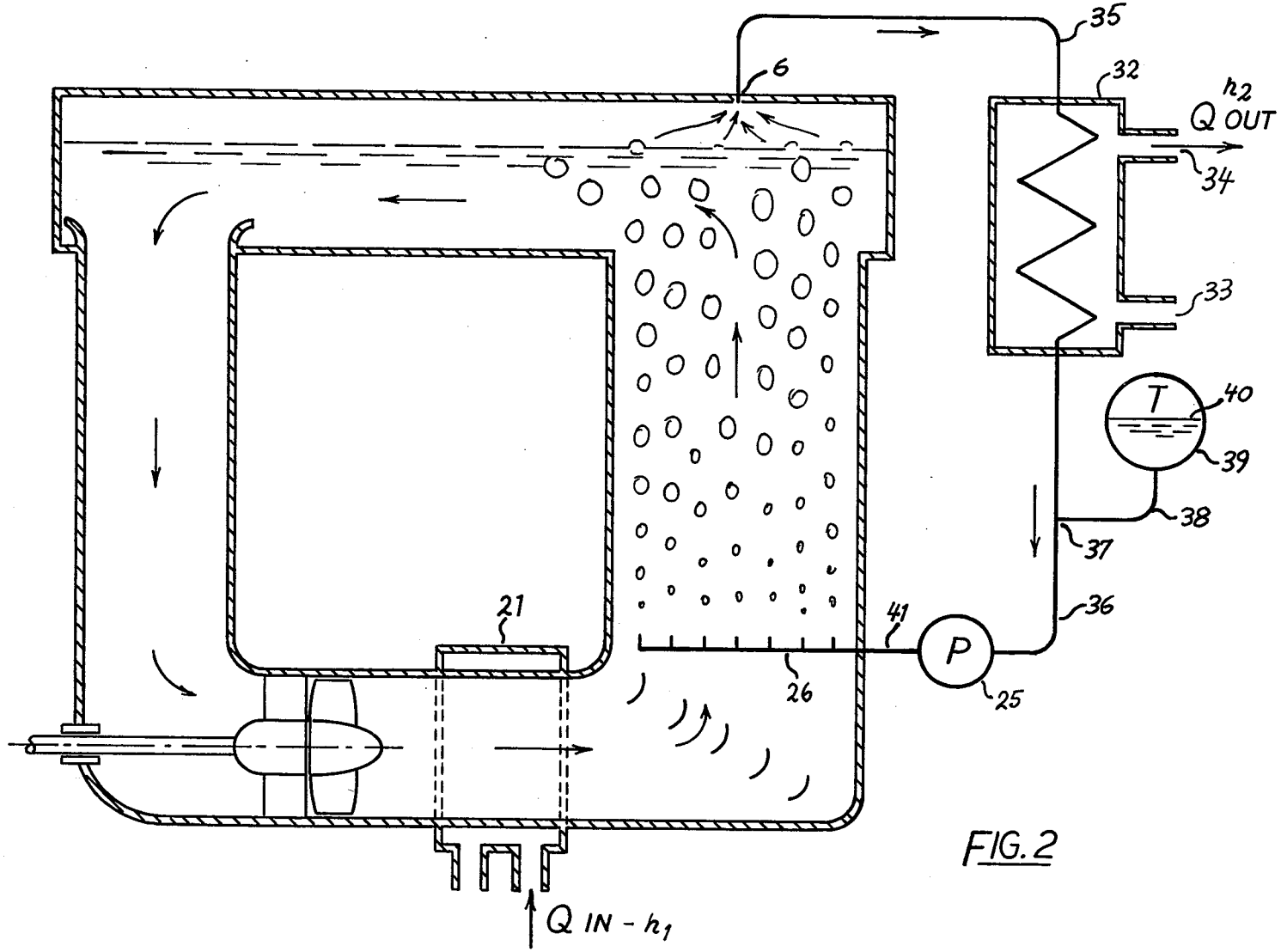
FIG. 2 shows the same device in a schematical sectional view in combination with its heat vapor cycle, representing, in its entirety, a heat engine system.

Drawing 2, FIG. 2, shows the device herein in combination with its connected heat vapor cycle components, representing a complete heat engine system consisting of the basic prime mover device (shown separately in Drawing 1, FIG. 1) and the condenser heat exchanger 32 having a cooling water inlet 33 and its outlet 34, wherein said condenser heat exchanger 32 is connected via suitable piping 35 to the gas separator's gas outlet 6 and via suitable piping 36 to the system's liquid gas pump 25. The piping 36 has a junction 37 which is connected via piping 38 to the system's liquid gas accumulator 39 showing its fluid level 40.

The pump 25 is connected via piping 41 to the gas inducer 26, thereby completing the gas's cycle consisting of the cooled gas's induction by pump to heated fluid; its heat absorption, evaporation and subsequent expansion which is doing work on the fluid; its separation from the fluid, as well as its cooling and condensation to initial state.

The system's heat-vapor cycle utilizes a gas having a boiling point substantially lower than that of water at a given temperature and corresponding pressure, such as "Freon 12" ($CCl_2F_2$) or "Freon 22" ($CHClF_2$), as well as other suitable gases, all of which must be chemically inert to the prime mover's recirculating non-compressible fluid.

There are four basic elements in the system herein: the pump 25 and the basic prime mover component Drawing 1, FIG. 1, whose function it is to transfer work, as well as the primary fluid heating means 21, and the gas cycle's condenser-cooler 32, whose function it is to transfer heat energy. Heat is supplied to the system only through the fluid's primary heating means 21 ($h_1$), and the remainder is ejected through the condenser-cooler 32 ($h_2$). The system's thermal losses are held to a minimum, since the entire system is thermally insulated.

The foregoing detailed descriptions are to be understood as given by way of illustration and example only. The spirit and the scope of this invention are limited solely by the appended claims.

What is claimed is:

1. A hydrodynamic prime mover device consisting of a closed, vertically oriented fluid recirculation system, utilizing a non-compressible fluid as a working medium and consisting of: a first vertically oriented fluid duct means and a second vertically oriented fluid duct means being laterally connected with each other at their uppermost and their lowermost portion in such a way as to assure a fluid flow from one into the other;

which fluid recirculation system has a fluid downward flow-oriented section, as well as a fluid upward flow-oriented section;

wherein said fluid downward flowing section comprises part of said upper lateral fluid conduit, said first vertical fluid duct means and part of said lower lateral fluid conduit;

and wherein the part of said lower lateral fluid conduit includes a hydraulic-turbine being connected via shaft to an electrical generator means;

which fluid downward flow-oriented section serves the function of generating electrical energy, first through the conversion of the downward flowing fluid's hydrodynamic potential into kinetical energy and then into mechanical energy by driving said turbine which, in turn, drives said electrical generator;

whereas said fluid upward flow-oriented section comprises the second part of said lower lateral fluid conduit, said second vertically oriented fluid duct means, as well as the second part of said upper lateral fluid conduit;

wherein the second part of said lower lateral fluid conduit includes a primary heating means for the heating of the turbine exhausted fluid and the maintenance of the operating temperature thereof, having a separate heating fluid inlet and a separate heating fluid outlet;

and wherein said second vertically oriented fluid duct means includes a gas inducer means at its lowermost effective portion for the induction of a cooled gas at liquid state into the heated upward flowing fluid, as well as including said second part of said upper lateral fluid conduit, which, in the whole, is a hermetically sealed fluid gas separator having a gas outlet at its uppermost portion and a substantial vertical space between the therethrough flowing fluid's surface and the inner upper containment wall;

which upward flow-oriented section serves the function of lifting the turbine exhausted and heated fluid back to its initial potential through the heat absorption of said induced cooled gas in contact with said heat fluid and its subsequent evaporation and expansion therein;

which expanded gas, by virtue of its fluid displacing action, gives rise to the lowering of the gas-containing fluid mass's specific gravity within the device's vertical riser, in contrast to the specific gravity of the gasless downward flowing fluid within the device's penstock;

thus, in turn, giving rise to the establishment of a difference in the hydrodynamic potentials between the downward and the upward flowing fluid respectively;

which, in turn, keeps the recirculating fluid in motion as long as a steady supply of thermal energy and a steady flow of cooled gas is made available to said device.

2. A claim as in claim 1 in combination, comprising: a condenser cooler means having a separate cooling water inlet and a separate cooling water outlet and being connected via suitable piping means to said gas separator's gas outlet means and with a suitable second piping means to the system's fluid pump means;

and said fluid pumping means is connected via suitable piping means to the inlet of said device's gas inducer means;

thus completing the gas's cycle, which comprises the introduction of a cooled gas at liquid state by pump to said heated upward circulating fluid, its heat absorption from said heated fluid and evaporation to operating pressure, its expansion and doing work on said upward circulating fluid and its separation from said fluid, as well as its cooling and condensation to initial state.

* * * * *